US005865645A

United States Patent [19]

Embo et al.

[11] Patent Number: 5,865,645

[45] Date of Patent: Feb. 2, 1999

[54] ANGULAR PRESS-FIT PLUG CONNECTOR FOR PRESS-FITTING INTO HOLES IN A PRINTED CIRCUIT BOARD

[75] Inventors: Georges Embo, Langemark; Rik Sterckx, Oostkamp, both of Belgium; Franz Czeschka, Rechberghausen, Germany

[73] Assignees: Siemens Aktiengesellschaft, Munich; Erni Elektroapparate GmbH, Adelberg, both of Germany

[21] Appl. No.: 808,786

[22] Filed: Feb. 28, 1997

[30] Foreign Application Priority Data

Feb. 28, 1996 [DE] Germany ..... 19607548

[51] Int. Cl.[6] ..... H01R 13/60

[52] U.S. Cl. ..... 439/567; 439/607

[58] Field of Search ..... 439/79, 567, 571, 439/607, 826, 943, 947

[56] References Cited

U.S. PATENT DOCUMENTS 4,789,346 12/1988 Frantz ..... 439/599 X
5,249,974 10/1993 Wang ..... 439/567 X

FOREIGN PATENT DOCUMENTS 82 07 123.3
U1 8/1982 Germany .
33 18 135 C2 11/1984 Germany .
88 06 699.1
U1 8/1988 Germany .
295 15 592
U1 1/1996 Germany .
545 060 1/1974 Switzerland .

*Primary Examiner*—Khiem Nguyen
*Attorney, Agent, or Firm*—Herbert L. Lerner; Laurence A. Greenberg

[57] ABSTRACT

A press-fit plug connector for press-fitting into holes in a printed circuit board, includes contacts which are each fastened at one end in a parallelepipedal plastic body and laterally guided in a molded part in slot-like recesses that are open toward the printed circuit board. The contacts have a free end with a press-fit section which is bent away toward the printed circuit board and two press-fit shoulders. The molded part is constructed with press-fit areas. A plug-in surface of the plug connector is constructed with a shielding plate having parts which are perpendicular to the printed circuit board and define a front plane of the plug connector. The molded part is of approximately U-shaped construction and free ends of U legs together with the plastic body disposed therebetween, abut against the front plane.

1 Claim, 4 Drawing Sheets

ANGULAR PRESS-FIT PLUG CONNECTOR FOR PRESS-FITTING INTO HOLES IN A PRINTED CIRCUIT BOARD

BACKGROUND OF THE INVENTION

Field of the Invention

The invention relates to a press-fit plug connector for press-fitting into holes in a printed circuit board, including contacts which are fastened at one end in an essentially parallelepipedal plastic body and are laterally guided in a molded part in slot-like recesses that are open toward the printed circuit board, the contacts have a free end with a press-fit section which is bent away at right angles toward the printed circuit board and in each case is provided with two press-fit shoulders, the molded part is constructed with press-fit areas which are parallel to the printed circuit board, are disposed next to the recesses and interact with the press-fit shoulders during a press-fitting operation, and a plug-in surface of the plug connector is formed by a shielding plate having parts which are perpendicular to the printed circuit board and define a front plane of the plug connector.

An angular press-fit female strip connector of the above-described type is disclosed in the registered German Utility Model DE 295 15 592. In principle, press-fitting through the use of a flat punch, that is to say "by way of plastic" and without special tools with pressure pins, has also already been disclosed in German Patent DE 33 18 135 C2.

In the case of the press-fitting principle illustrated in the documents cited above, it is provided to transmit pressure exerted areally from above at right angles to the printed circuit board, through the use of press-fit areas in the molded part, directly onto press-fit shoulders disposed on press-fit sections of the contacts. Since the press-fit pressure is exerted very near and in a line with the press-fit zone, neither bending moments nor buckling of the contact can be produced in the case of that press-fitting method. What is problematic in known plug connectors is the structural layout, in particular the configuration and fastening of the individual parts with respect to one another and with respect to the printed circuit board. In addition to the mechanical stability of the structure and the fastening problems, there is often the further problem of integrating a ground contact possibility between the metallic plug-in surface and the printed circuit board in the already largely predetermined connector structure.

SUMMARY OF THE INVENTION

It is accordingly an object of the invention to provide an angular press-fit plug connector for press-fitting into holes in a printed circuit board, which overcomes the hereinaforementioned disadvantages of the heretofore-known devices of this general type.

With the foregoing and other objects in view there is provided, in accordance with the invention, a press-fit plug connector for press-fitting into holes in a printed circuit board, comprising a substantially parallelepipedal plastic body; an approximately U-shaped molded part having slot-like recesses open toward a printed circuit board, press-fit areas disposed parallel to the printed circuit board and next to the recesses, U legs with free ends, a U base acting as a pressure surface during press-fitting, and fastening pegs each integrally formed on a respective one of the U legs toward the printed circuit board; contacts laterally guided in the slot-like recesses and each having one end fastened in the plastic body, a free end with a press-fit section bent away at right angles toward the printed circuit board and two press-fit shoulders interacting with the press-fit areas during press-fitting; and a shielding plate defining a plug connector plug-in surface, the shielding plate having parts perpendicular to the printed circuit board defining a plug connector front plane from which the fastening pegs are set back and against which the free ends of the U legs and the plastic body disposed between the free ends abut.

In accordance with a concomitant feature of the invention, the fastening peg is slotted and has two halves, and there are provided approximately Z-shaped ground contact plates each associated with a respective one of the U legs, the contact plates having first and second short legs perpendicular to the printed circuit board and a long leg parallel to the printed circuit board, the first short leg being inserted between the free end of the U leg and the shielding plate, and the second short leg being a printed circuit board connection clip disposed between the two halves of the fastening peg.

Other features which are considered as characteristic for the invention are set forth in the appended claims.

Although the invention is illustrated and described herein as embodied in an angular press-fit plug connector for press-fitting into holes in a printed circuit board, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 7 is a rear perspective view of a plug-in strip connector with the shielding cage having been put on.

DESCRIPTION OF THE PREFERRED EMBODIMENTS

Figure 1:
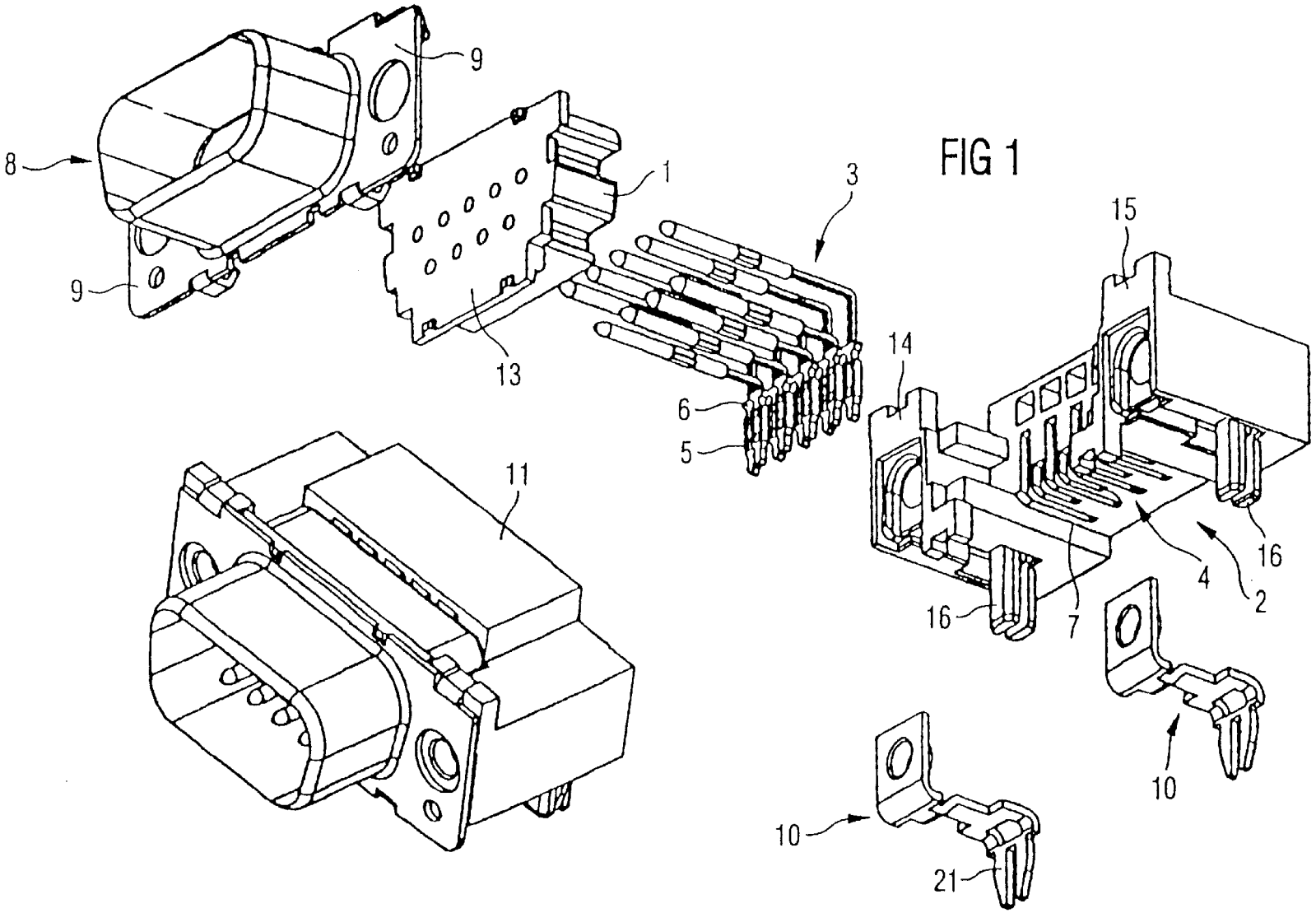
FIG. 1 is an exploded, perspective, plan view of a plug-in strip connector according to the invention, illustrating its individual parts.
Figure 4:
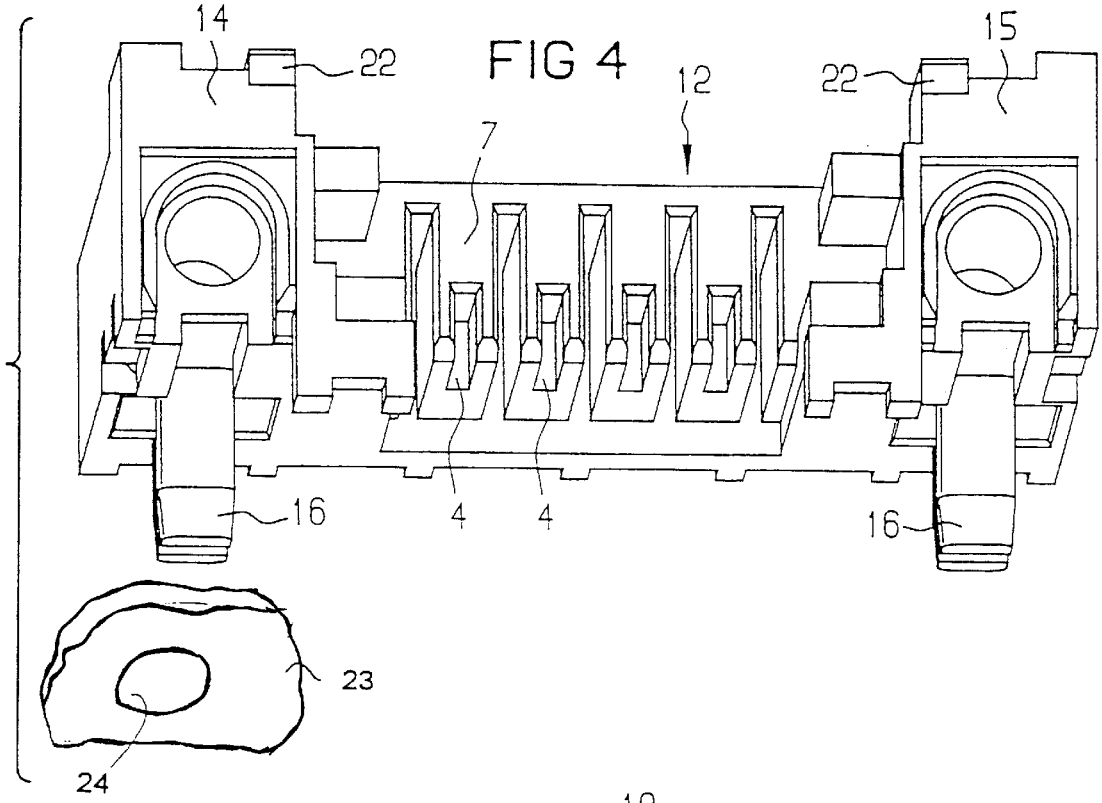
FIG. 4 is an oblique view of the underside of a second plastic body.

Referring now to the figures of the drawings in detail and first, particularly, to FIG. 1 thereof, there is seen a shielding plate 8, a plastic body 1, two rows of contacts 3, a molded part 2 and two ground contact plates 10 which are individually illustrated next to one another, in an upper part of the figure. The shielding plate 8 has parts 9 which define a front plane of the plug connector and are perpendicular to a printed circuit board 23, a portion of which is shown in FIG. 4. The contacts 3, which have press-fit sections 5 and press-fit shoulders 6, are initially press-fitted into the plastic body 1 in the straight condition and then bent through 90 degrees. The plastic molded part 2 is pushed from the rear side over the angular contacts 3, with the result that press-fit areas or regions 7, which are also seen in FIG. 4, come to lie directly over the press-fit shoulders 6 and can interact with the latter during the press-fitting operation. In this case, the above-mentioned known press-fitting principle is again brought to bear, with the result that neither bending moments nor instances of buckling are produced. A pressure surface 11 of a ready assembled plug-in strip connector illustrated in the lower part of FIG. 1 is disposed above and parallel to the press-fit areas 7. The molded part 2 has U legs with free ends 14, 15 extending to the left and right of the plastic body 1. In this part of the figure, it is also possible to discern that an end surface 13 of the plastic body 1 which is oriented toward the mating connector forms a line with the free ends 14, 15 and jointly abuts with the ends against the rear of the shielding plate 8.

Figure 3:
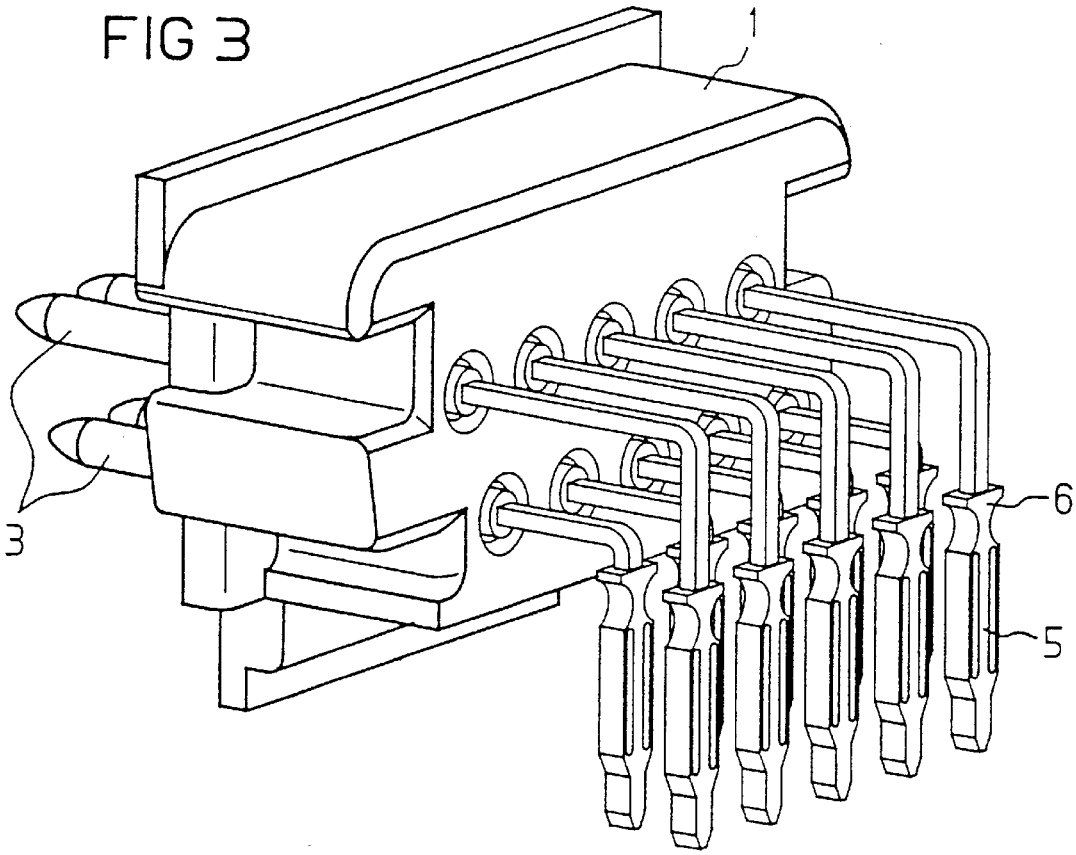
FIG. 3 is a perspective view of a first plastic body with contacts having been inserted.

The press-fitted contacts 3 and the plastic body 1 can be discerned particularly well in FIG. 3. The molded part 2 has a U base 12 with an underside facing the printed circuit board. Pocket-shaped or slot-shaped recesses 4 next to the areas 7 on the underside of the U base 12 can be discerned, in particular, in FIG. 4. The bearing of the press-fit shoulders 6 against the press-fit areas 7 is seen, for example, from the illustration according to FIG. 5, in which the molded part 2 is configured somewhat differently from FIG. 1.

Figure 2:
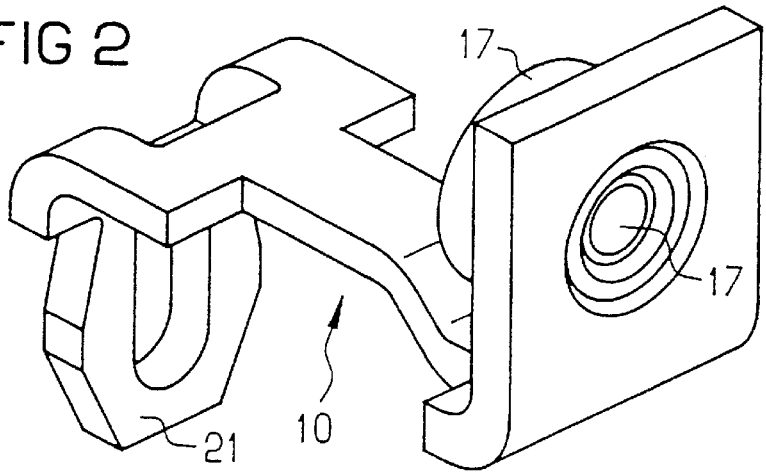
FIG. 2 is an enlarged, perspective view of a Z-shaped ground contact plate.
Figure 5:
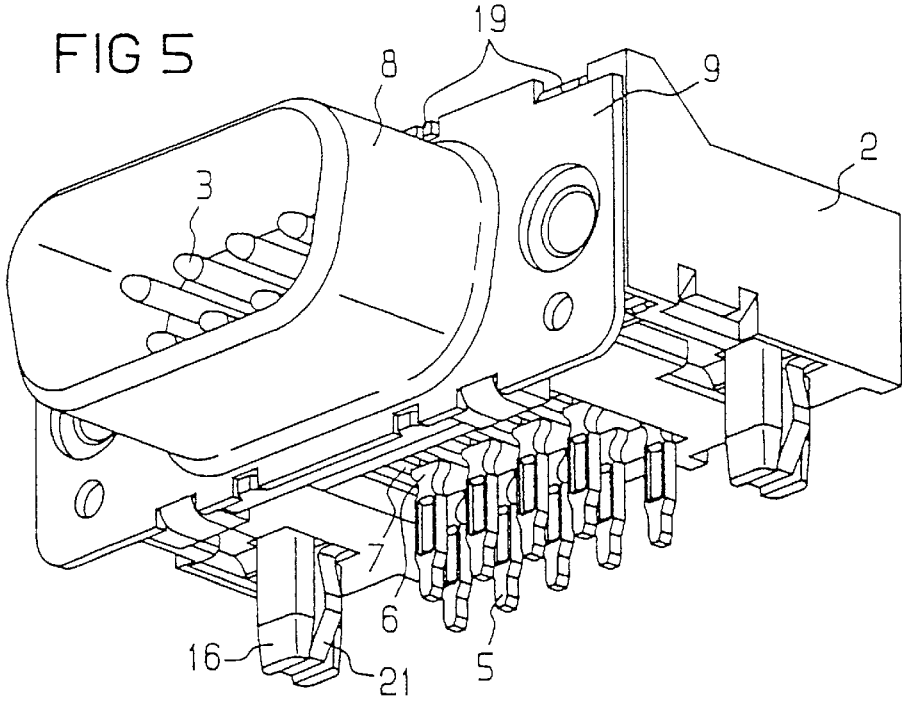
FIG. 5 is an oblique, perspective view from below of a ready assembled plug-in strip connector.

The comb-like recesses 4 next to the areas 7 illustrated in FIGS. 1, 4 and 5 have the further advantage of causing the connection grid pattern of the contacts 3 to be accurately routed. With a coordinated selection of the geometry, it is even possible to accommodate different contact cross sections, such as round or rectangular contacts, in identically shaped molded parts 2. The invention is, of course, equally suitable for male strip connectors and for female strip connectors. Two plastic molded pegs 16 are concomitantly formed on the molded part 2 and they ensure the mechanical fastening of the plug connector on the printed circuit board 23. The two ground contact plates 10 which are illustrated, in particular, in FIGS. 1 and 2 can be inserted during final assembly. The plates 2 serve a dual function:

ground contact between the shielding plate and the printed circuit board; and a possibility for mechanical interlocking of the mating connector through the use of a thread 17 integrated in a plug-in surface seen FIG. 2.

The Z-shaped configuration together with the slotted fastening pegs 16 yield a particular advantage which is that the two functions "fastening" and "ground contact" in each case do not require two, but rather just one printed circuit board hole 24. Printed circuit board connection clips 21, which are constructed somewhat differently in FIGS. 1 and 2 and which have press-fit zones, virtually no longer have a fastening function.

Figure 6:
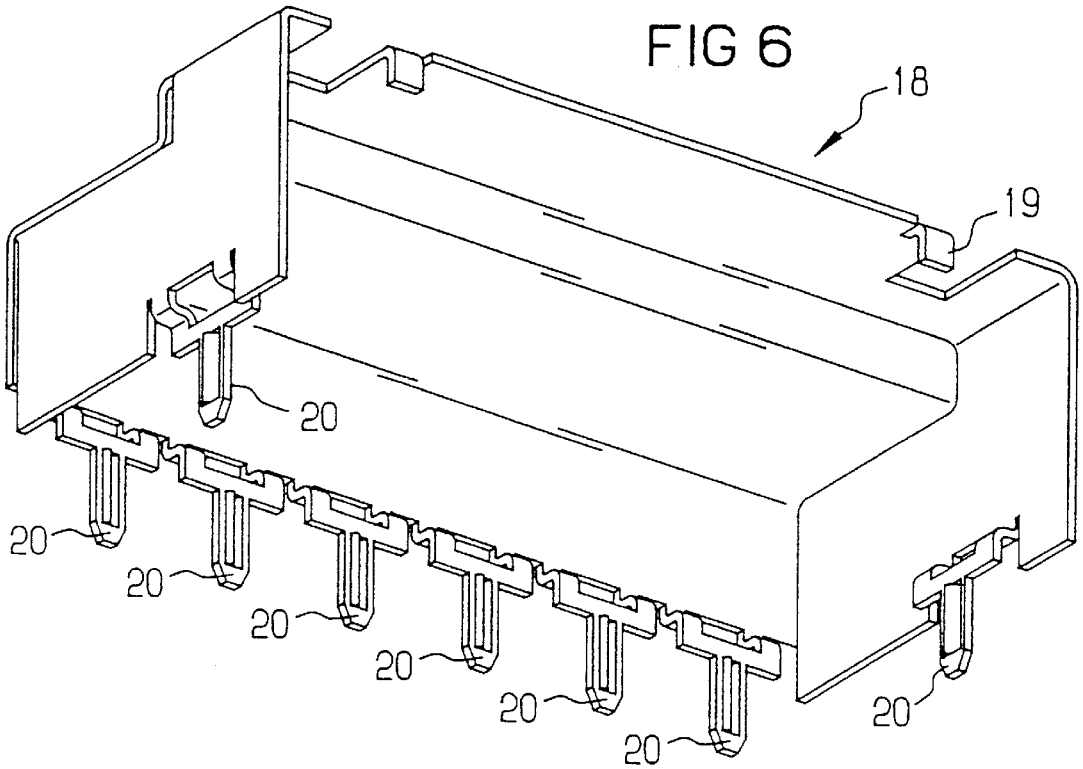
FIG. 6 is a perspective view of a shielding cage.
Figure 7:
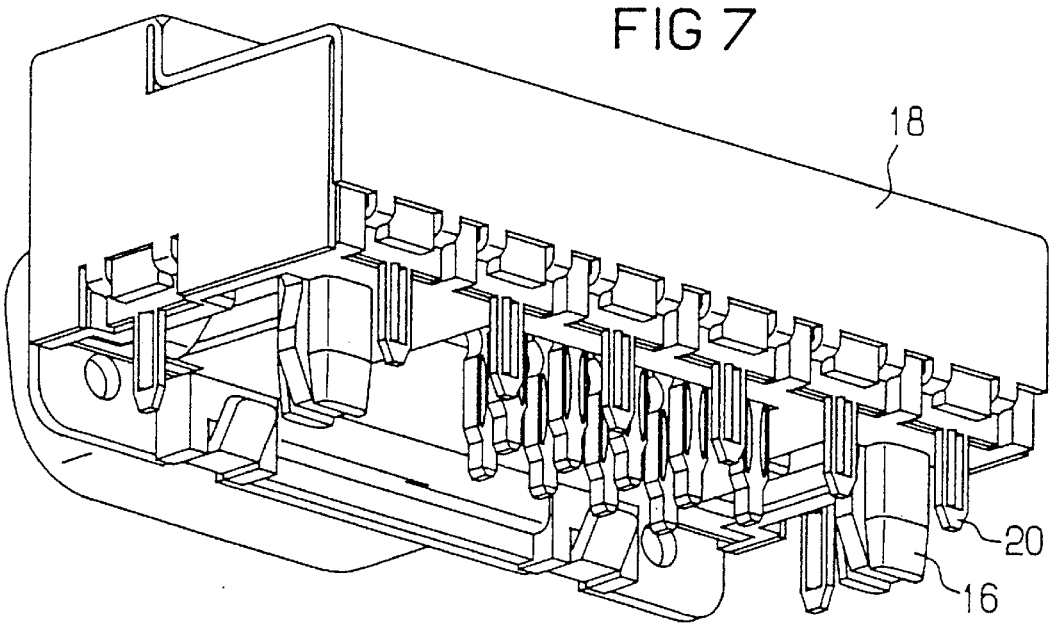

In order to satisfy elevated shielding requirements, it is possible, as required, to integrate a metallic shielding cage 18 shown in FIG. 6. This shielding cage 18 also subsequently takes over the ground bypass to the printed circuit board and mounting rack grounding. For this purpose, lugs 19 are clamped between the shielding plate 8 and the molded part 2 and connections 20 which are molded in the form of an S are shaped in such a way that they are offset under the molded part 2. Consequently, during the emplacement and press-fitting operation, these connections 20 are also press-fitted and locked together with the contacts 3 and the two ground bypasses 10 into the printed circuit board in the same mounting action. Recesses 22 for the lugs 19 can be discerned, for example, in FIG. 4.

We claim:

1. A press-fit plug connector for press-fitting into holes in a printed circuit board, comprising:

a substantially parallelepipedal plastic body;

an approximately U-shaped molded part having slot-like recesses open toward a printed circuit board, press-fit areas disposed parallel to the printed circuit board and next to said recesses, U legs with free ends, a U base acting as a pressure surface during press-fitting, and fastening pegs each integrally formed on a respective one of said U legs toward the printed circuit board;

contacts laterally guided in said slot-like recesses and each having one end fastened in said plastic body, a free end with a press-fit section bent away at right angles toward the printed circuit board and two press-fit shoulders interacting with said press-fit areas during press-fitting;

a shielding plate defining a plug connector plug-in surface, said shielding plate having parts perpendicular to the printed circuit board defining a plug connector front plane from which said fastening pegs are set back and against which said free ends of said U legs and said plastic body disposed between said free ends abut; and said fastening peg being slotted and having two halves, and including approximately Z-shaped ground contact plates each associated with a respective one of said U legs, said contact plates having first and second short legs perpendicular to the printed circuit board and a long leg parallel to the printed circuit board, said first short leg being inserted between said free end of said U leg and said shielding plate, and said second short leg being a printed circuit board connection clip disposed between said two halves of said fastening peg.

* * * * *